United States Patent [19]

Ohrberg

[11] 3,969,986

[45] July 20, 1976

[54] RADIAL PISTON PUMP

[75] Inventor: Carl Verner Ohrberg, Nordborg, Denmark

[73] Assignee: Danfoss A/S, Nordborg, Denmark

[22] Filed: Jan. 11, 1973

[21] Appl. No.: 322,883

Related U.S. Application Data

[63] Continuation of Ser. No. 169,827, July 6, 1971, abandoned, which is a continuation of Ser. No. 877,363, Nov. 17, 1969, abandoned.

[52] U.S. Cl. ..... 91/492

[51] Int. Cl.[2] ..... F01B 13/06

[58] Field of Search ..... 91/492, 485, 487, 494

[56] References Cited

UNITED STATES PATENTS

| | | | |
|---|---|---|---|
| 3,086,477 | 4/1963 | Ruhl | 91/485 |
| 3,357,362 | 12/1967 | Orr | 91/492 |
| 3,398,698 | 8/1968 | Elckmann | 91/485 |
| 3,470,825 | 7/1967 | Gsching | 91/494 |

*Primary Examiner*—William L. Freeh

[57] ABSTRACT

The invention relates to a radial piston type pump comprising a casing, a shaft, two or more piston carriers mounted on and driven by the shaft, and a curved track surrounding the piston carriers. The piston carriers are axially movable on the shaft and pressure chamber and scaling means are provided between adjacent carriers to bias them in opposite directions against the internal casing walls which form a chamber in which the carriers are rotatably mounted. Fluid inlet and outlet means in one of these casing walls has fluid communication with the inlet and outlet passages in the carriers and the biasing of a carrier against this wall serves to provide sealing between the relatively rotating surfaces to minimize the leaking of fluid between these surfaces.

8 Claims, 4 Drawing Figures

RADIAL PISTON PUMP

Figure 1:
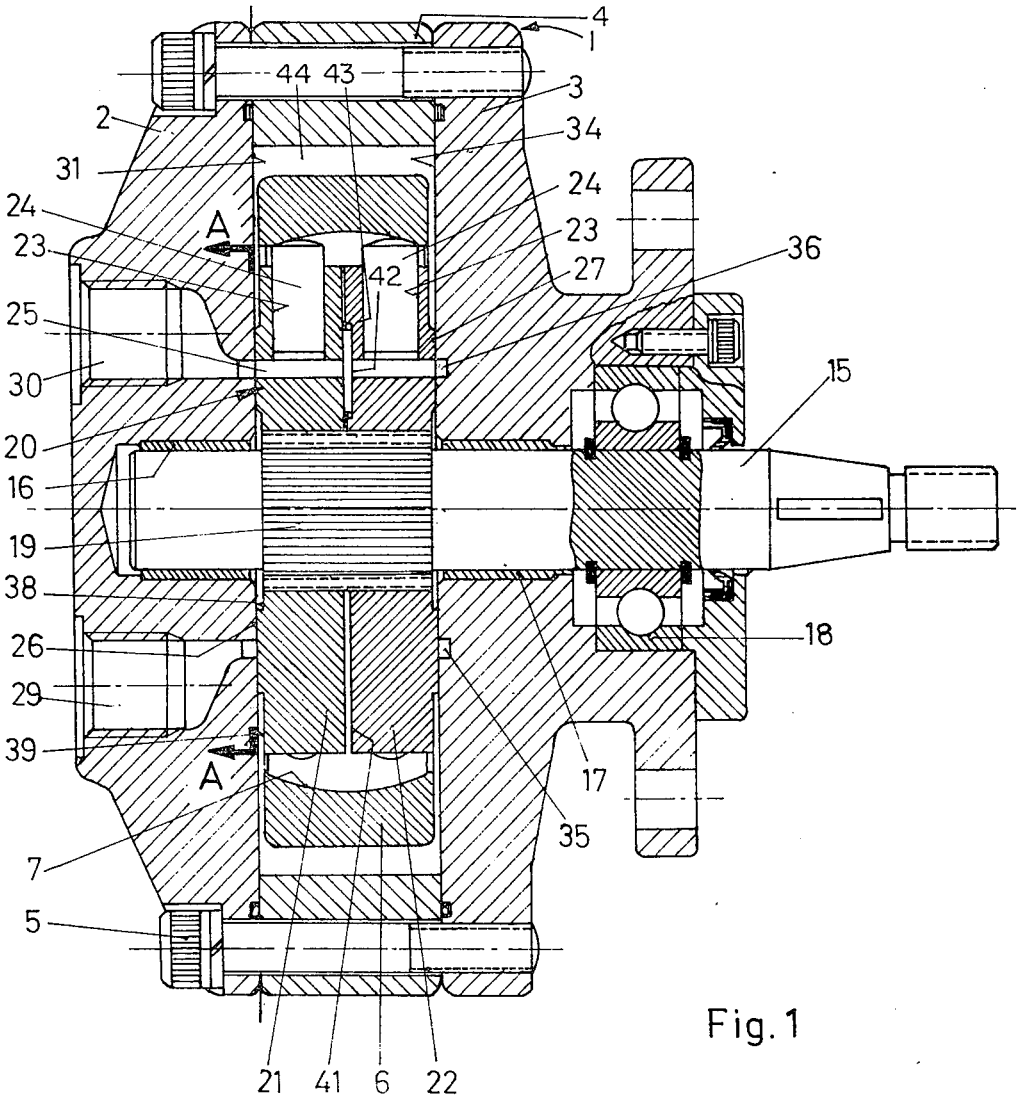

This is a continuation application of Ser. No. 169,827 filed July 6, 1971, now abandoned, which in lieu is a continuation application of Ser. No. 877,363 filed Nov. 17, 1969, now abandoned.

The invention relates to a radial piston pump comprising a driving shaft and two parts, rotatable relatively to each other, one (the piston carrier) of which has radially disposed cylinders for accommodating the pistons and distributing passages leading from the inner end of each cylinder to a transfer surface, and the other (the track carrier) of which carries a curved track for guiding the outer piston ends and contains a suction passage and a pressure passage, each communicating with the transfer surface.

Radial piston pumps are known in which the piston carrier rotates on a fixed pivot and, for this purpose, is connected to the driving shaft through a laterally positioned coupling. The fixed pivot is part of a case on which the curved track is immovably or swingably mounted. The distributing passages extend radially; the transfer surface is on the peripheral surface of the pivot; the suction and pressure passages extend through the pivot.

In pumps of this kind, the piston carrier is lifted from the pivot on the pressure side of the transfer surface and is pressed against it on the suction side. Balancing is very difficult, particularly at high pressures. The transfer surface is limited to the periphery of the pivot. Thus, the cross-sections of the cooperating mouths of the distributing passages and the suction and pressure passages are relatively small; flow is inhibited and sets a limit to the speed of the pump. Also, the distance between the mouths of the passages on the pressure side and the suction side is small; the correspondingly poor seal leads to losses due to leakage, which limit the pump pressure. It is undesirable to increase the size of the pivot since the centrifugal forces acting on the pistons increase quadratically with the distance from the axis. The machining of the pivot to provide it with suction and pressure passages causes considerable difficulties. Also, the driving of the piston carrier through a laterally positioned coupling makes the construction more expensive and makes it relatively wide.

For all these reasons an axial piston pump has been used in the past in those cases calling for a multi-cylinder pump for higher pressures and greater speeds, in which pump a number of cylinders are arranged parallel with each other and with the axis of the pump in the piston carrier, and the pistons are driven through appropriate piston rods by a wobble plate connected to the driving shaft. Extending from those ends of the cylinders remote from the wobble plate are distributing passages which, in some types of pump, open on to a transfer surface at right-angles to the axis of the pump, in which surface are also disposed the mouths of the suction and pressure passages. These axial piston pumps however require a larger number of components than do the radial piston pumps. Furthermore, the quantity delivered cannot be increased as required since, in contrast to the radial piston pump, a number of piston carriers cannot be coupled together in a simple manner.

The object of the invention is to provide a construction of radial piston pump of the initially described kind such that, although of simple design, it avoids the disadvantages of the known radial and axial piston pumps and can be operated over wide pressure, speed and power ranges.

According to the invention, this object is achieved by holding the piston carrier of the radial piston pump against the wall of the track carrier by at least one end-face and forming the transfer surface on this end-face.

Since, in this construction, the transfer surface is on an end-face of the piston carrier, the radial distance from the axis of the pump can be freely selected. No difficulties arise in arranging the transfer surface in such a way that the co-operating mouths as well as the distance between the pressure side and the suction side mouths of the passages are sufficiently large. Furthermore, by means of balancing devices acting in the axial direction, the piston carrier can be prevented from tilting and the gap at the transfer surface can be kept so small that scarcely any losses due to leakage occur. The pump can therefore be operated at high speeds and pressures.

A design feature worth mentioning is that the piston carrier can be secured directly to the driving shaft which passes through it. Not only does this dispense with a coupling which increases the axial length, but the pistons can be brought closer to the axis of the pump than was previously the case, other conditions being the same. There is thus obtained a pump which is of small size for its capacity. Nor is it necessary to manufacture a complicated pivot. Several pump units can be mounted on the same shaft, each unit having a piston carrier and the associated suction and pressure passages, so that several consumer units can be supplied independently of each other by means of one driving shaft.

The piston carrier is preferably positioned between two parallel walls of the track carrier. In simple cases the second wall suffices for holding the piston carrier sufficiently tightly against the other wall comprising the transfer surface.

It is however much more advantageous if the piston carrier consists of at least two discs which are urged apart and towards the two walls with the help of a pressure device. Expediently, this pressure device is used not only for producing a certain bearing pressure at the transfer area, but should also effect a pressure-balance. If, for example, the pressure device has at least one pressure chamber, fed with the pressure medium handled by the pump, a bearing pressure at the transfer surface is obtained that is dependent upon the pump pressure, so that the losses due to leakage can be kept low while the amount of wear is very small. Furthermore, the pressure device may contain a number of pressure chambers, of which only those axially associated with the pressure-side part of the transfer surface are supplied with pressure medium delivered by the pump. This ensures that increased bearing pressure is produced only in that zone where it is necessary for sealing purposes.

In a particularly simple construction, the pressure chambers are formed by circular depressions in the contact surface and preferably in only one of the opposite discs into each of which is sunk an O-ring for sealing purposes. Since movement of the piston carrier discs by a few hundredths of a millimeter suffices to produce the required bearing pressure on the transfer surface, such O-ring suffices for sealing the pressure chamber.

Preferably, the number of depressions provided around the axis of the pump is equal to the number of cylinders in one plane. Than, a pressure chamber of this kind can be associated with each cylinder and can be used for effecting the compensation required for the cylinder concerned and the associated distributing passages.

In a preferred embodiment there is associated with each cylinder an axis-parallel distributing passage extending to the inner end of the cylinder. This passage can be easily made. It extends over only a short radial distance. Several cylinders disposed alongside each other can be connected thereby without difficulty.

If the axis-parallel distributing passages pass completely through one of the piston carrier discs between the transfer surface and the contact surface and each terminate within an O-ring, this constitutes an extremely simple way of ensuring that, in each case, an adequate bearing pressure obtains at the transfer surface at the correct moment. Furthermore, the axial passages in the two discs can be tightly interconnected despite their axial mobility.

A further improvement in the balancing of pressure leading to considerable reduction in wear consists in arranging for the axis-parallel distributing passages to extend right through the entire piston carrier and to have the same shape of mouth at both ends and in providing in the wall opposite the transfer surface grooves which are mirror-images of the mouths of the suction and pressure passages. As a result of the straight-through distributing passages the same conditions obtain in the mirror-image grooves as in the zone of the transfer surface, so that the piston discs are loaded in a symmetrical manner.

Expediently, the end-faces of the piston carrier are set back within and outside the annular transfer surface. By reducing the bearing surface in this manner, it is possible to obtain, even with relatively small pressure chambers, higher specific surface pressures promoting a good sealing action. In this arrangement, the annular transfer surface can be of approximately the same width as the diameter of the depressions in the pressure chamber. Furthermore, a set-back portion of the end-face can be designed as a floating thrust bearing.

Figure 3:
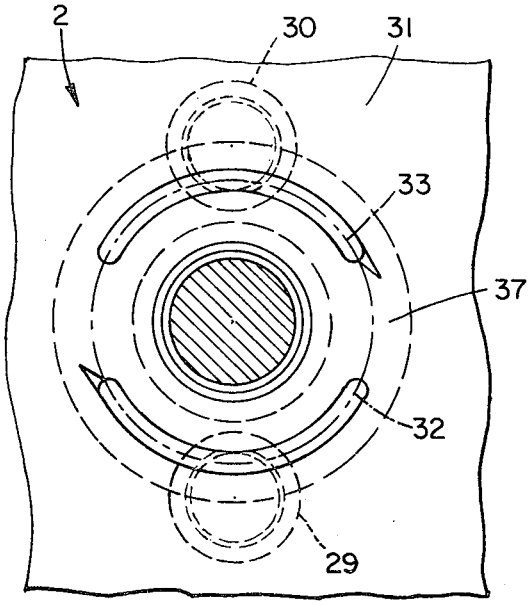
Figure 2:
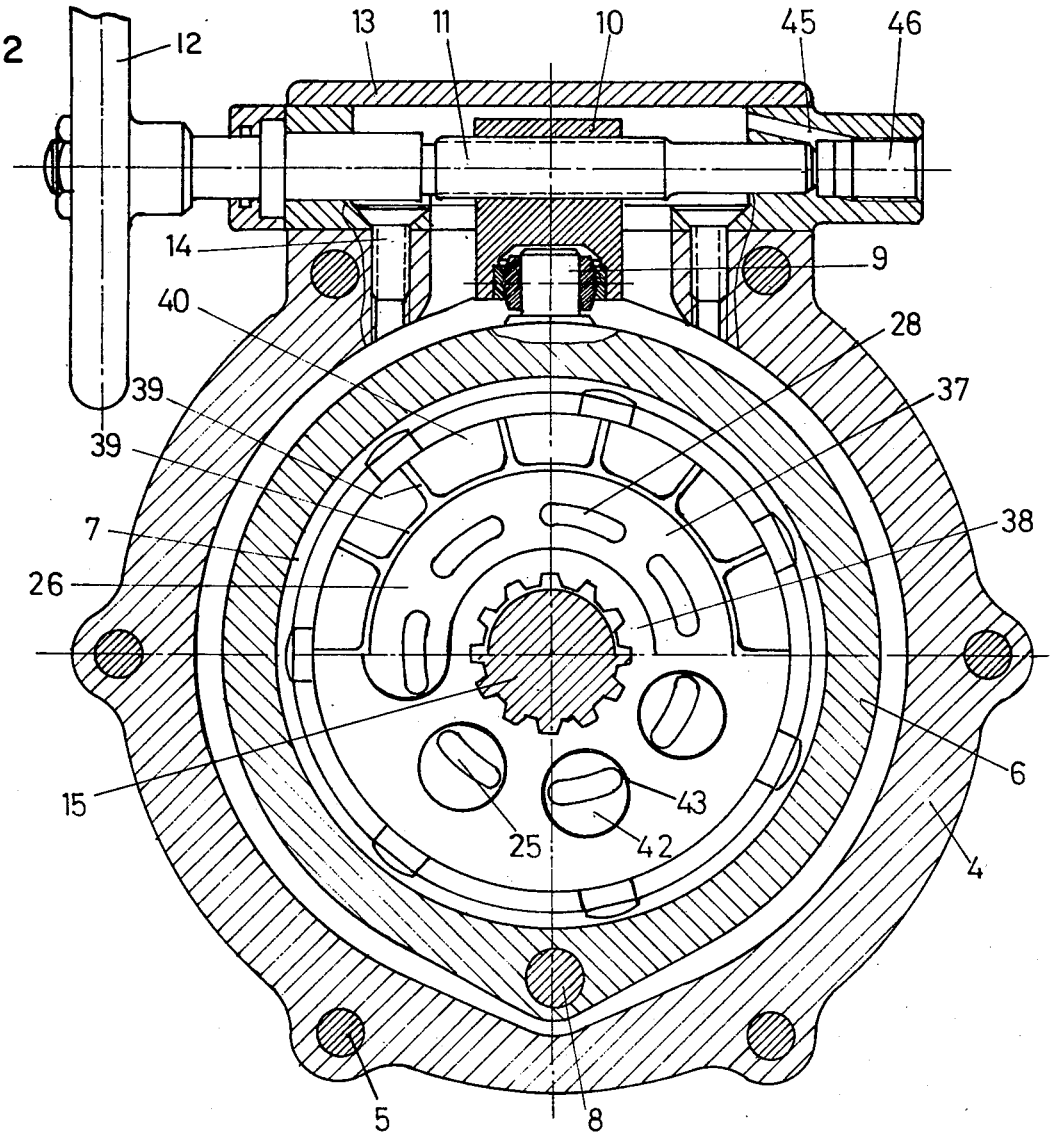
Figure 4:
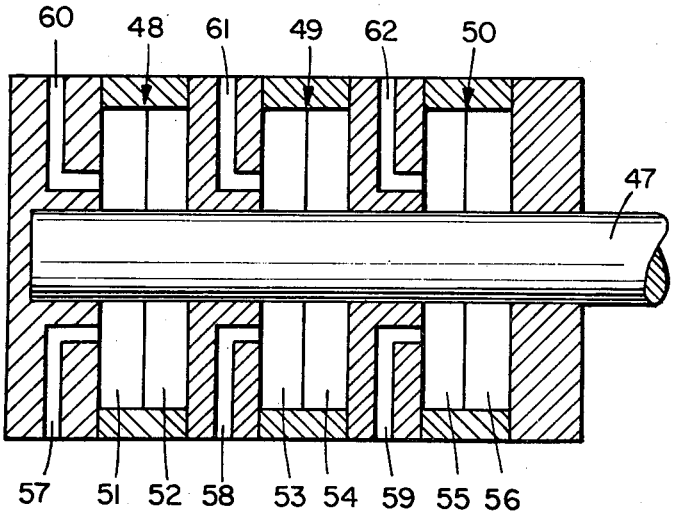

The invention will now be described in more detail by reference to embodiments illustrated in the drawing, in which:

FIG. 1 shows a longitudinal section through a radial piston pump in accordance with the invention, FIG. 2 is a cross-section through the pump of FIG. 1, the section in the upper half being along the transfer surface, and in the lower half along the contact surface of one of the piston carrier discs, FIG. 3 is a partial view on the line A — A of FIG. 1, and FIG. 4 is a schematic illustration of an embodiment comprising several pump units.

A case or track carrier 1 has two cover-plates 2 and 3, which are separated by a distance ring 4 and held together by means of screw-bolts 5. A ring 6, on the inside of which is formed a circular track 7, can swing about a pivot 8 secured to the case. Provided at the opposite end is a pivot 9 around which extends a block 10 which can be moved backwards and forwards by means of a screwed spindle 11 and hand-wheel 12. This adjusting means is supported in an attachment 13 secured to the track carrier 1 by means of screw-bolts 14.

A driving shaft 13 is mounted in two sleeve-bearings 16 and 17 in the cover-plates 2 and 3 respectively and is secured against axial displacement by means of a ball-bearing unit. 18. Supported on a toothed portion 19 of the shaft 15 is a piston carrier 20, which consists of two discs 21 and 22. Each disc has seven radially extending cylinders 23 positioned at the same distances apart, pistons 24 being displaceable in the cylinders. When the shaft 13 rotates the pistons are pressed by centrifugal force towards the track 7 and are pushed radially inwards to an extent depending upon the eccentricity of the track-ring 6 relatively to the shaft 15.

At its inner end, each cylinder 23 is connected to a passage 25 extending parallel with the axis. This passage passes through both discs 21 and 22 from one of the outer end-faces 26 to the other end-face 27 and there has a math 28 which corresponds to its total cross-section. In the cover-plate 2 are a suction passage 29 and a pressure passage 30 which, in the inner wall 31 of the cover-plate 2 lead to arcuate mouths 32 and 33 in the form of grooves. The inner wall 34 of the cover-plate 3 contains grooves 35 and 36 which are mirror images of the mouths 32 and 33. Between the end-face 26 of the disc 21 and the wall 31 of the cover-plate 2 is an annular transfer surface 37 within which are disposed the mouths 28 of the passages 25 and the mouths 32 and 33 of the suction and pressure passages 29 and 30 respectively. The zone 38 inwardly of the annular transfer surface 37 is set back in the case of disc 21. Outwardly of the annulus 37 is an annular groove 39 having outwardly extending radial grooves 39', so that the remaining surface zones 40 constitute a kind of floating bearing. The opposite end-face 27 of the disc 22 is of similar configuration.

Provided in the disc 22 at the contact surface 41 between said disc and disc 21 are seven circular depressions 42 each of which accommodates an O-ring 43. The diameters and positions of the depressions 42 are such that in each case an axial passage 25 is completely encompassed. A pressure chamber is thus created. At the same time the passages 25 in the two discs 21 and 22 are interconnected in a fluid-tight manner.

The pressure medium handled by the pump passes outwards along the transfer surface 37, between the piston 24 and the cylinder 23 or along the contact surface 41, collects in the chamber 44 and from there can be discharged through a passage 24 and a port 46.

To start up the pump, the shaft 15 is driven and the track-ring 6 is moved off-centre from the shaft by means of the hand-wheel 12. Then, three pairs of pistons execute a suction stroke and three pairs a pressure stroke each time, while the seventh pair of pistons have just reached their bottom or top dead centre. In the present embodiment, the upper pistons in FIG. 1 execute the pressure-stroke. Consequently the depression 42 is also under pressure from the pressure medium, so that the two discs 21 and 22 are, at this point, urged apart and towards the walls 31 and 34 of the cover-plates 2 and 3 respectively. A good seal therefore results at the transfer surface 37. However, as soon as the piston concerned has completed the pressure stroke, the pressure in the recess 42 is relaxed and, accordingly, so is the bearing pressure at the associated area on the transfer surface 37, this reducing wear to a corresponding extent. It follows from this that the two rings 21 and 22 are at all times pressed to an increased extent at their transfer surfaces 37 only when this is necessary for the purpose of effecting a seal.

FIG. 4 shows that three pump units 48, 49 and 50, illustrated only schematically, can be powered by one driving shaft 47. Three pairs of piston carriers, 51, 52 and 53, 54 and 55, 56 are provided. Each pump has its own suction passage 57, 58 and 59 and its own pressure passage 60, 61 and 62.

The basic idea behind the invention can be modified in numerous ways. For example, the passages 25 need not run parallel with the axis. An inclined arrangement thereof results in the pistons 24 being drawn still farther inwards and in the mouths 26 of the passages nevertheless being positioned farther towards the outside. Also, more than two discs 21 and 22 can be used. The various cylinders can be interconnected with the help of axial passages. The passages between the discs are again sealed by means of O-rings. Nor does the second disc 22 need to carry any pistons and, if required, it may be of very small thickness.

I claim:

1. A radial piston pump comprising a casing having a generally cylindrically shaped chamber with first and second walls having first and second spaced and parallel internal surfaces, one and only one of said walls having fluid feeding and exhausting passages which have direct fluid communication with the exterior of said casing, a shaft rotatably mounted in said casing, a pair of first and second generally cylindrically shaped piston carriers in said chamber, said carriers having adjacent and opposite surfaces, said carriers being attached to said shaft for rotation therewith and axial movement relative thereto, one of said carriers having a first set of fluid inlet and outlet passages extending transversely thereof, the other of said carriers having a second set of fluid inlet and outlet passages extending transversely thereof, said carriers being indexed relative to each other with said first set of passages in said one carrier being respectively aligned with and having fluid communication with said second set of passages in said other carrier, at least one of said adjacent surfaces having at least one recessed surface portion in surrounding relation to at least one of said passages and sealing means between said adjacent carrier surfaces in surrounding and radially spaced relation to the mouths of said passages, said sealing means including at least one sealing element in surrounding relation to said recessed surface portion, said recessed surface portion being exposed to pressurized fluid in at least one of said passages to force said carriers apart into sealing engagement with said first and second wall surfaces.

2. A radial piston pump according to claim 1 wherein each of said carrier fluid inlet and outlet passages is alternately a suction passage and a pressure passage, said sealing means having a separate portion thereof for each pair of said passages.

3. A radial piston pump according to claim 2 wherein said passages extend entirely through said carriers between said opposite surfaces thereof.

4. A radial piston pump according to claim 3 including fluid inlet and outlet means in said first wall having arcuately shaped mouths in said first surface of said first wall, said second wall surface having grooves which are mirror images of said arcuately shaped mouths, said passages having mouths in said opposite surfaces of said carriers having fluid communication with said arcuately shaped mouths and said grooves.

5. A radial piston pump according to claim 1 wherein said sealing means forms a plurality of chambers between said adjacent surfaces of said carriers.

6. A radial piston pump according to claim 5 wherein said chambers are alternately pressure chambers and suction chambers in accordance with the pressure condition of the fluid in said carrier fluid inlet and outlet passages.

7. A radial piston pump according to claim 5 wherein each of said chambers has the form of a circular recess in at least one of said adjacent carrier surfaces.

8. A radial piston pump according to claim 7 wherein each of said circular recesses has an O-ring disposed therein.

* * * * *